US008038026B2

(12) United States Patent
Auer et al.

(10) Patent No.: US 8,038,026 B2
(45) **Date of Patent: *Oct. 18, 2011**

(54) REMOVABLE LOCKING CONTAINER COVER WITH SLOTTED OUTER SKIRT

(75) Inventors: Robert Thomas Auer, East Stroudsburg, PA (US); Jason Wesley Stull, Morristown, NJ (US)

(73) Assignee: Stull Technologies, Inc., Somerset, NJ (US)

( * ) Notice: Subject to any disclaimer, the term of this patent is extended or adjusted under 35 U.S.C. 154(b) by 1141 days.

This patent is subject to a terminal disclaimer.

(21) Appl. No.: 11/824,791

(22) Filed: Jul. 2, 2007

(65) Prior Publication Data

US 2008/0169287 A1 Jul. 17, 2008

Related U.S. Application Data

(63) Continuation-in-part of application No. 11/654,322, filed on Jan. 17, 2007, now Pat. No. 7,594,588, and a continuation-in-part of application No. 11/542,547, filed on Oct. 3, 2006.

(51) Int. Cl.
*B65D 41/18* (2006.01)
*B65D 51/16* (2006.01)

(52) U.S. Cl. ..... 220/326; 220/784; 220/367.1; 215/216

(58) Field of Classification Search ..... 220/326, 220/367.1, 784; 215/216
See application file for complete search history.

(56) References Cited

U.S. PATENT DOCUMENTS

| | | | | |
|---|---|---|---|---|
| 247,547 | A | 9/1881 | Eisemann | |
| 471,911 | A | 3/1892 | Sutro | |
| 1,482,931 | A | 2/1924 | Keehn | |
| 2,205,685 | A | 9/1936 | Conner | |
| 2,695,806 | A | 2/1953 | Balint | |
| 3,083,861 | A | 4/1963 | Amberg et al. | |
| 3,499,574 | A | 3/1970 | Yates, Jr. | |
| 3,642,161 | A | 2/1972 | Stroud | |
| 3,688,942 | A | 9/1972 | Mitchell et al. | |
| 3,703,975 | A | 11/1972 | Wittemer | |
| 3,868,041 | A | 2/1975 | Knize | |
| 3,885,712 | A | 5/1975 | Libit | 222/153.14 |
| 3,964,634 | A | 6/1976 | Jasinski et al. | |
| 4,014,452 | A | 3/1977 | Galer | |
| 4,051,972 | A * | 10/1977 | Botkin | 215/260 |

(Continued)

FOREIGN PATENT DOCUMENTS

WO WO 91/02685 3/1991

*Primary Examiner* — Anthony Stashick
*Assistant Examiner* — James N Smalley
(74) *Attorney, Agent, or Firm* — Drinker Biddle & Reath LLP

(57) ABSTRACT

A container cover for use with a container having a neck. The cover includes a lid, a skirt extending downward from the circumference of the lid, a concentric plug seal extending from the lid inside the skirt. The cover also may include vent holes in the lid. The skirt preferably includes at least two lock panels. The sides of the lock panels are defined by vertical slots in the skirt, and each lock panel features at least one inwardly-projecting locking wedge. When the cover is locked on the container, the locking wedges engage a lip on the container neck. When a user wishes to remove the cover, the user pulls up on the edge of a lock panel, disengaging the locking wedges from the container lip and removing the cover.

16 Claims, 7 Drawing Sheets

U.S. PATENT DOCUMENTS

| | | | | | |
|---|---|---|---|---|---|
| 4,079,857 | A | | 3/1978 | Crisci | |
| 4,119,239 | A | | 10/1978 | Anderson | 220/324 |
| 4,209,107 | A | | 6/1980 | Crisci | |
| 4,210,258 | A | | 7/1980 | von Holdt | |
| 4,230,235 | A | | 10/1980 | Di Amico | |
| 4,244,920 | A | | 1/1981 | Manschot et al. | |
| 4,349,119 | A | | 9/1982 | Letica | |
| 4,387,828 | A | | 6/1983 | Yates, Jr. | |
| 4,390,110 | A | | 6/1983 | Pirro | |
| 4,480,762 | A | | 11/1984 | Thomas | |
| 4,526,289 | A | | 7/1985 | Schiemann | 220/304 |
| 4,530,440 | A | | 7/1985 | Leong | |
| 4,579,257 | A | | 4/1986 | Brandlein | 222/192 |
| 4,595,111 | A | | 6/1986 | Gould et al. | |
| 4,676,388 | A | | 6/1987 | Kuboshima | 215/217 |
| 4,687,112 | A | | 8/1987 | Swartzbaugh | |
| 4,718,571 | A | | 1/1988 | Bordner | |
| 4,752,013 | A | | 6/1988 | Miller et al. | |
| 4,752,014 | A | | 6/1988 | House et al. | 215/216 |
| 4,815,628 | A | | 3/1989 | Wehnert, III | |
| 4,936,494 | A | * | 6/1990 | Weidman | 222/480 |
| 4,949,865 | A | | 8/1990 | Turner | 220/713 |
| 5,042,683 | A | | 8/1991 | Shaw et al. | |
| 5,180,072 | A | | 1/1993 | Oehlert | |
| D334,324 | S | | 3/1993 | Pierce | |
| 5,232,116 | A | | 8/1993 | Baxter | |
| 5,275,287 | A | | 1/1994 | Thompson | |
| 5,292,017 | A | | 3/1994 | Reifers | |
| 5,310,981 | A | | 5/1994 | Samoff et al. | 219/731 |
| D353,444 | S | | 12/1994 | Merrett | |
| 5,375,730 | A | | 12/1994 | Bahr et al. | 220/324 |
| 5,377,860 | A | | 1/1995 | Littlejohn et al. | |
| 5,449,077 | A | | 9/1995 | Seidler | |
| 5,452,818 | A | | 9/1995 | Yost | |
| 5,518,133 | A | | 5/1996 | Hayes et al. | |
| 5,558,240 | A | | 9/1996 | Karp | |
| 5,603,421 | A | | 2/1997 | Opresco | |
| 5,695,086 | A | | 12/1997 | Viola | |
| 5,706,963 | A | | 1/1998 | Gargione | |
| 5,769,258 | A | | 6/1998 | Harrison et al. | 220/203.1 |
| 5,833,116 | A | | 11/1998 | Guillin | |
| 5,865,330 | A | | 2/1999 | Buono | |
| 5,881,907 | A | | 3/1999 | Schutz | |
| 5,894,953 | A | | 4/1999 | Ramirez | |
| 5,908,125 | A | | 6/1999 | Opresco | 215/216 |
| 5,915,581 | A | | 6/1999 | Pfirrmann et al. | |
| 5,921,417 | A | | 7/1999 | Mull | |
| 5,927,526 | A | | 7/1999 | Herr | |
| 5,960,979 | A | | 10/1999 | Van Den Brink et al. | |
| 6,036,036 | A | | 3/2000 | Bilani et al. | |
| 6,047,852 | A | | 4/2000 | Evans et al. | |
| 6,056,138 | A | | 5/2000 | Chen | |
| 6,112,921 | A | | 9/2000 | Robinson | |
| 6,202,869 | B1 | | 3/2001 | Sullivan | |
| 6,296,130 | B1 | | 10/2001 | Forsyth et al. | |
| 6,315,146 | B1 | | 11/2001 | Johnsen | |
| 6,364,152 | B1 | | 4/2002 | Poslinski et al. | |
| 6,431,385 | B1 | | 8/2002 | Palmer | 220/324 |
| 6,439,409 | B1 | | 8/2002 | Dressel et al. | |
| 6,460,716 | B1 | | 10/2002 | Wong | |
| 6,575,323 | B1 | | 6/2003 | Martin et al. | |
| D478,282 | S | | 8/2003 | Hayes et al. | |
| 6,607,089 | B2 | | 8/2003 | Ferguson | |
| 6,612,450 | B1 | | 9/2003 | Buono | 215/228 |
| 6,644,494 | B2 | | 11/2003 | Hayes et al. | |
| 6,783,019 | B2 | | 8/2004 | Zettle et al. | |
| 6,910,599 | B2 | | 6/2005 | Tucker et al. | |
| 6,923,338 | B2 | | 8/2005 | Dees et al. | |
| 7,063,231 | B2 | | 6/2006 | Stanos et al. | |
| 7,823,746 | B1 | | 11/2010 | McCumber | |
| 2002/0148845 | A1 | | 10/2002 | Zettle et al. | |
| 2002/0190067 | A1 | * | 12/2002 | Getsy | 220/256.1 |
| 2003/0085227 | A1 | | 5/2003 | Azzarello | |
| 2004/0195241 | A1 | | 10/2004 | Stull et al. | |
| 2005/0145627 | A1 | | 7/2005 | Stull et al. | |
| 2006/0255041 | A1 | | 11/2006 | Parks et al. | |
| 2006/0255052 | A1 | | 11/2006 | Svitak | |
| 2007/0012710 | A1 | | 1/2007 | Vovan | |
| 2008/0110911 | A1 | | 5/2008 | Chen | |

* cited by examiner

REMOVABLE LOCKING CONTAINER COVER WITH SLOTTED OUTER SKIRT

RELATED APPLICATION

This application is continuation-in-part of U.S. patent application Ser. No. 11/654,322, filed on Jan. 17, 2007, and a continuation-in-part of U.S. patent application Ser. No. 11/542,547, filed on Oct. 3, 2006, the entirety of both applications are incorporated herein by reference.

FIELD OF THE INVENTION

The present invention relates generally to removable covers for containers, and more particularly, to removable and reusable covers for use with microwavable containers.

BACKGROUND OF THE INVENTION

It is known to provide a removable cover for a container, such as a container of food or drink. Many such containers can be placed in a microwave oven to heat their contents. The cover or closure functions to prevent the contents of the container from spilling when the container is moved, or splattering when being heated in the microwave. However, many prior art container covers have suffered from deficiencies. Depending on their construction, they may be difficult to put on or to remove, or may be too easily detached, thereby resulting in inadvertent removal of the cover. Many prior art container covers suffer from distortion when heated in the microwave. As a result, the attachment of the cover to the container is impaired or the quality of the seal between the cover and the container is reduced.

A need, therefore, exists for a cover which is easier to put onto and take off of a container, inhibits inadvertent removal, and that seals more dependably.

SUMMARY OF THE INVENTION

The invention is directed to a container cover for use with a container having a neck with an outer bead ring or lip. In exemplary embodiments, the container cover comprises a lid with a skirt extending downward from the circumference of the lid and a concentric plug seal extending downward from the bottom of the lid disposed inside the skirt. The skirt includes a plurality of flexible locks each having at least one inwardly projecting wedge, which hold the cover in place on the container by engaging the container neck bead ring. An edge of each lock is defined by a slot extending through the skirt that allows the lock to flex to disengage the bead ring.

When the cover is installed on the container, the wedges on the inside of the locks engage the outside of the container neck, and the plug seal preferably sealingly engages the inside of the container neck. In an embodiment, the lid is circular and fits on a container neck with a circular cross section. In an embodiment, the skirt has two slotted flexible locks disposed on opposite sides of the cover.

Other objects, aspects and advantages of the present invention will become apparent to those skilled in the art upon reading the following detailed description, when considered in conjunction with the appended claims and the accompanying drawings briefly described below.

BRIEF DESCRIPTION OF THE DRAWINGS

For the purpose of illustrating the invention, there is shown in the drawings embodiments that are presently preferred; it being understood, however, that this invention is not limited to the precise arrangements and constructions particularly shown. In the drawings.

DETAILED DESCRIPTION OF THE PREFERRED EMBODIMENTS

Figure 1:
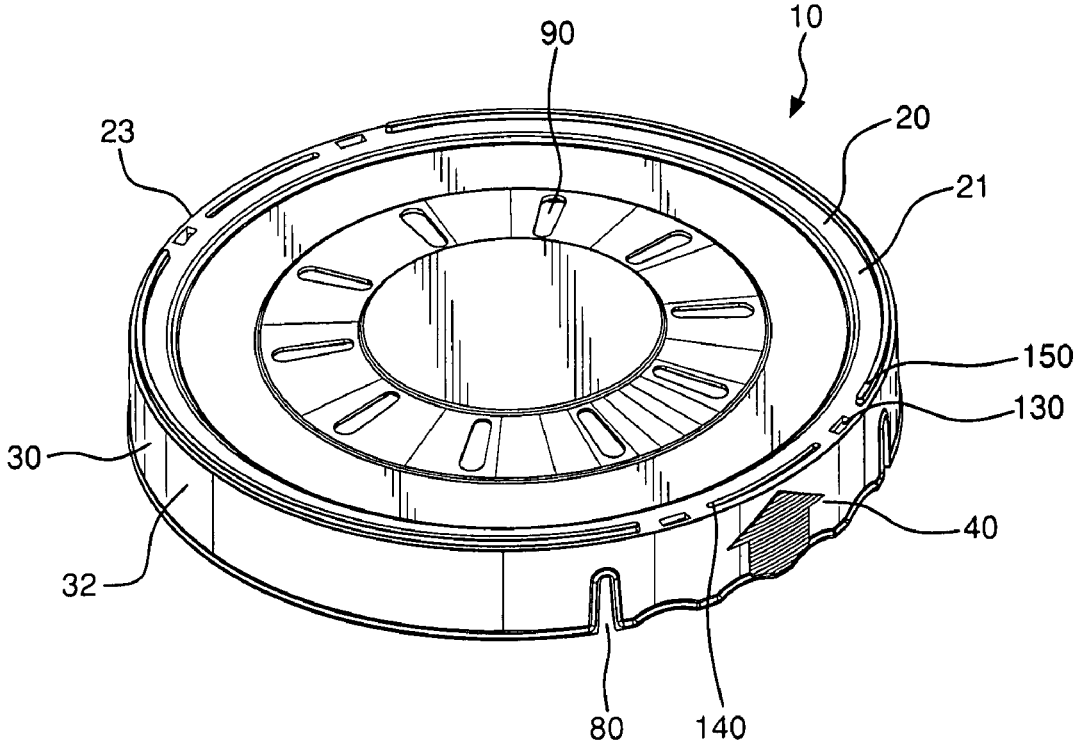
FIG. 1 is an isometric view of an embodiment of a container cover according to the present invention.

Referring now to the drawings which illustrate several preferred embodiments of the invention, a container cover is shown for use on a microwavable container. The container cover preferably includes a plurality of integral locks. The cover is preferably microwavable and easily removed and reapplied to the container by the user. It is contemplated that the cover can be locked onto the top lip of the container during an assembly process at the factory, keeping the top surface of the container clean during shipping and storage. To remove the cover cap, the user can pull up on the lock. This mechanical action moves the lock away from the container bead ring, making it possible to lift a section of the cover. Simultaneously as the user lifts up on one section of the cover, the cover is moved forward in an arc, causing the other lock or locks to flex, thereby disengaging them from the container rim.

In an exemplary implementation, after the user has removed the cover, the user opens the container, such as by pulling upward on a now exposed metal ring tab of a sealed container top, completely separating the top from the container and discarding it. Next, the user replaces the cover cap and places the container and cover combination into a microwave. Vent holes may be included and serve to vent steam generated in the container by the heating process.

Figure 3:
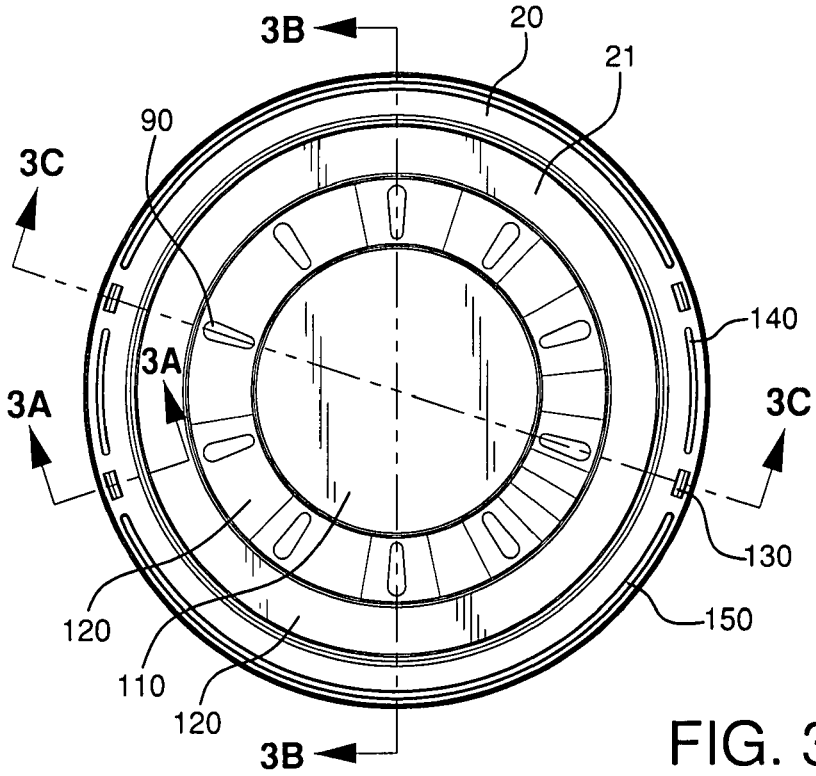
FIG. 3 is a plan view of the top of the container cover of FIG. 1.
Figure 3A:
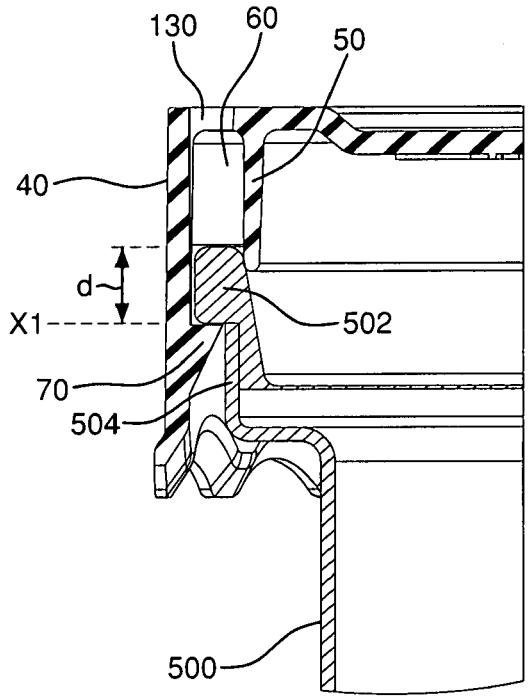
FIG. 3A is an enlarged partial section view of the cover shown in FIG. 3 taken along lines 3A-3A.

The container may be of any size or shape and may be fabricated from any of a variety of materials. Preferably, the container contains food products which are heated in a microwave oven prior to consumption. Therefore, container is preferably fabricated from a material suitable for use with food products and for heating in a microwave, for example a thermoplastic material such as polypropylene formed by injection molding. As shown in FIG. 3A, the container 500 preferably includes a neck or rim with a protruding lip having an outer bead ring 502, or similar structure proximate to its upper end 504. The outer bead ring 502 may be disposed directly adjacent to the upper end 504 of the container 500 or in close proximity thereto. While the container 500 and the cover 10 are illustrated as each having a substantially circular shape, it will be appreciated by those of ordinary skill in the art that the teachings of the invention are applicable to a variety of other shapes. The following description and embodiments of the invention are not intended to describe all cover/container combinations, but are merely illustrative of how the teachings of the present invention may be employed in the context of a preferred container configuration.

Figure 2:
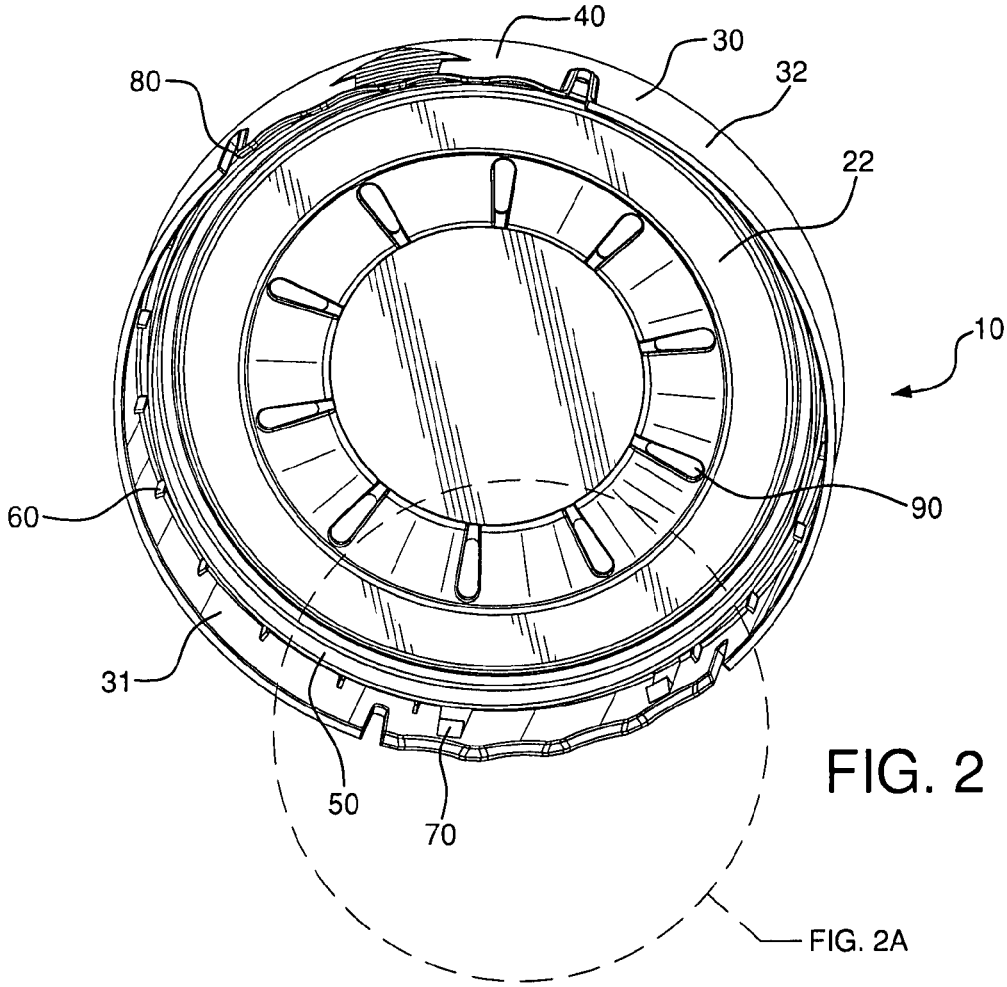
FIG. 2 is an isometric view of the bottom side of the cover of FIG. 1.

Referring to FIGS. 1 and 2, the container cover 10 includes a lid 20, having a top surface 21, a bottom surface 22, and a circumferential edge 23. When installed on the container, the top of the lid faces away from the container, and the bottom of the lid faces into the container. The cover also includes a skirt 30 extending downward from or near the circumferential edge 23 of the lid 20. The skirt 30 has an inner surface (or wall) 31 and an outer surface (or wall) 32. When installed on the container, the outer wall faces away from the container, and the inner wall faces toward the container and is preferably shaped to fit snugly around the outside of the container neck and/or outer bead ring. The container cover is held onto the container by a plurality of locks or lock panels 40. The lock panels engage the outer bead ring on the neck of the container, as will be described hereinafter.

FIG. 2 is an isometric view of the bottom of the cover of FIG. 1. FIG. 3C is a cross-sectional view of FIG. 3 (a top view of cover 10), seen along lines 3C-3C. Referring to FIGS. 2 and 3C, plug seal 50 is preferably formed concentrically to the skirt 30 and has a smaller diameter than the skirt. The plug seal 50 extends from the bottom of the lid and preferably connects along its entire length to the bottom of the lid. As shown in FIG. 3A, the plug seal 50 has an outer wall shaped to preferably fit snugly and sealingly against the inside of the neck or rim of the container. Thus, the plug seal 50 forms a seal against the inside surface of the container rim to prevent or inhibit the contents of the container from readily passing between the container cover and the container rim. As shown in FIGS. 2, 3A, and 3C, a plurality of stop ribs 60 preferably extend from the inside of the skirt and/or the bottom of the lid. The stop ribs are located so that, when the cover is installed on a container, the stop ribs touch the top of the container neck limiting the downward movement of the cover onto the container.

Figure 2A:
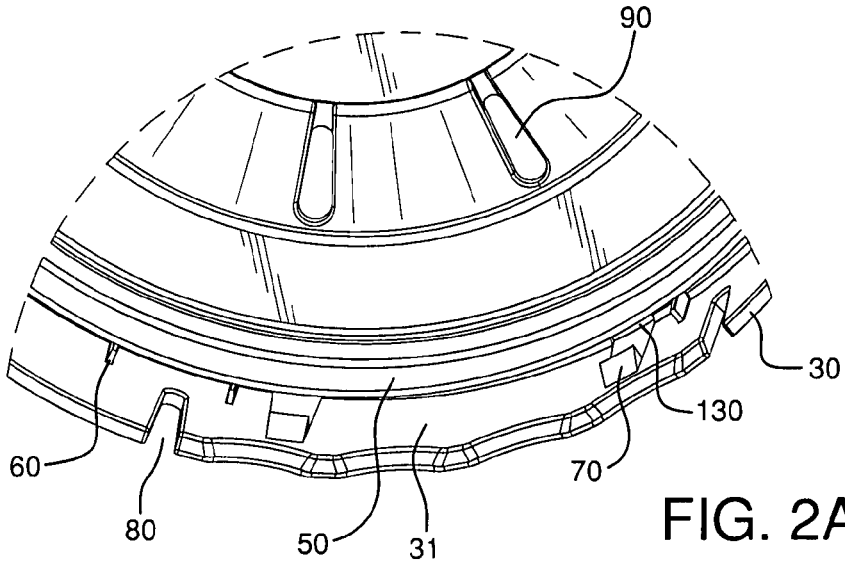
FIG. 2A is an enlarged view of a portion of the cover shown in FIG. 2.

FIGS. 2A and 3A illustrate the lock panel 40 in more detail. The lock panel 40 is preferably formed as part of the skirt 30. The lock panel includes at least one and more preferably two or more locking wedges 70 that extend inward from an inside surface of the lock panel 40. While only one wedge 70 is visible in FIG. 3A, FIG. 2A illustrates that it is preferable that each lock panel 40 includes a plurality of wedges 70. In a locked position, each locking wedge engages the lower edge of outer bead ring of the container. In an unlocked position, each wedge 70 is released from the outer bead ring 502.

FIG. 2A is an enlarged view of a portion of FIG. 2 showing the lock panel 40. Also shown are slots 80, which are formed in the skirt 30 on either side of the lock panel 40, thus defining the circumferential location of, which define the ends of lock 40. The slots extend at least partially up the skirt 30. Preferably the slots extend at least halfway up the skirt between the bottom and top of the skirt. More preferably, the slots 80 extend more than 50% of the skirt height. The slots permit the flexing of the lock panels 40, thereby permitting the locking wedges to disengage from the container bead 502.

The lock panel 40 includes the locking wedge 70, which extends from the inner wall of the skirt 30. The wedge 70 can be seen in FIGS. 2A and 3A in the shape of a triangle, with a substantially flat surface portion facing towards the top of the cover (i.e., upward). While the preferred embodiment includes a locking wedge that is triangular or wedge-shaped in cross-section, it is contemplated that other cross-sectional shapes, such as quadrangles or circular shapes, may be used.

Providing the slots 80 through the skirt 30 adds flexibility to the skirt and the lock panels. Defining a lock panel by the slots allows the panel to flex outward away from the container rim as the wedges pass over the container bead ring when the cover is applied or removed. When removing the cover, the slots in the skirt enable the lid to flex when the lock is lifted, promoting easy removal of the cover.

As shown in FIG. 3A, the level of the top of a locking wedge (i.e., the vertical location of the tops of the wedges on the skirt) is indicated by dashed line X1. The bottom of a stop rib 60 is also visible. The stop ribs 60 preferably extend from the skirt and/or the lid, and do not interfere with the plug seal 50 when the cover 10 is installed on a container. The distance d between the bottom of the stop rib 60 and the top of the locking wedge 70 is preferably sized so that when the cover is installed on a container having a bead ring 502 on its neck, the bottom of the stop rib 60 touches the top of the neck or the bead ring 502, and each locking wedge 70 engages the bottom of the container bead ring 502, thereby locking the container cover in place.

Prior to microwaving, the user removes the container lid by placing his finger tips under one of the lock panels and lifts upwards. The lifting action disengages the inside locking wedges that are molded on the inside surface of the lock. The slots through the skirt assist in removal of the cover by allowing the entire lock to flex while being pulled out and away from the container rim. When one lock is pulled upward, the other lock or locks begin to flex, causing the locking wedges on the other lock or locks to disengage from the container rim. Above each wedge is preferably a bypass hole 130 that runs through the top and bottom surfaces of the lid. In one preferred embodiment, the bypass hole 130 is formed during the molding process by dies the pierce downward through the lid. In one preferred embodiment, the die forces a portion of the lid material downward while in its moldable state to form the locking wedge. The illustrated embodiment in FIG. 2A shows a portion of the skirt above the locking wedge as being "shaved", which is the result of the die forming the locking wedge. Although the illustrated embodiment includes holes 130, it should be readily apparent that the openings are not necessary in the cover. Preferably, a flexing slot 140 (shown in FIG. 3) is centered between the bypass holes 130. As shown in FIGS. 1, 3, and 4A, this flexing slot follows the arc of the lid's circumferential edge and allows the lock panel to flex more easily. The increased flexibility of the lock panel due to the flexing slot enables the locking wedges to be placed father apart, providing a wider and more consistent locking pressure area.

As previously described, the container cover is preferably made from one piece injection-molded polypropylene. Polypropylene has a tendency to grow slightly when heated in a microwave oven; such growth creates dimensional changes and deviations. Because the plug seal is in closest proximity to the heating container contents, it tends to experience more thermal growth than the rest of the cover components. The plug seal expansion improves the seal between it and the container rim, thus serving to reduce the possibility of leakage when the contents are extremely hot. Because the locking wedges are also in direct contact with the container, spacing the wedges farther apart creates less vertical distortion of the cover components during heating.

Figure 3B:
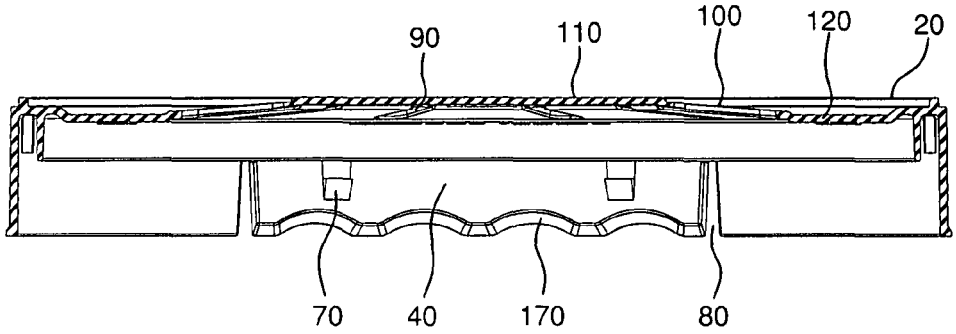
FIG. 3B is a cross-sectional view of the cover shown in FIG. 3 taken along lines 3B-3B.
Figure 3C:
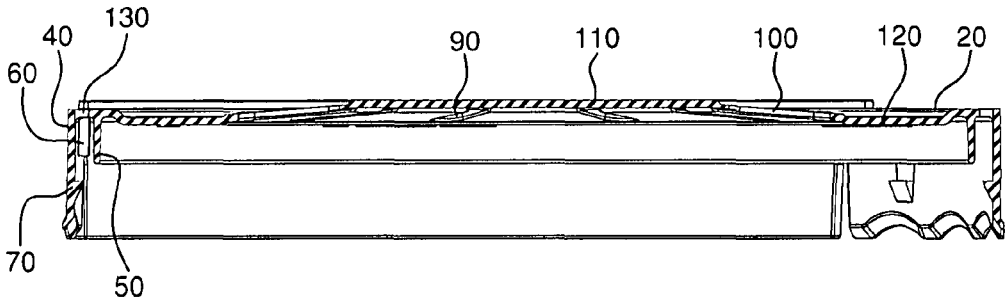
FIG. 3C is a cross-sectional view of the cover shown in FIG. 3 taken along lines 3C-3C.

FIGS. 3B and 3C are cross-sectional views of the cover 10. In these figures, it can be seen that lid 20 includes sloping transitional surface 100, which circumscribes a central upper surface 110. A lower annular surface 120 circumscribes the transitional surface 100. Vent holes 90 are preferably formed in the container cover 10 to allow air and steam to escape from the container when the container's contents are heated. It should be apparent to one of ordinary skill in the art that while the embodiment features a preferable number and arrangement of vent holes, any number or arrangement of holes may serve substantially the same purpose.

FIG. 3 is a view of cover 10, showing the top surface 21 of the lid 20. Visible in FIG. 3 are the vent holes 90, arranged on the sloping transitional surface 100. The lid 20 preferably has multiple open vent holes to automatically vent excess steam and heat that could build up during the microwaving process. If the steam was not vented, the steam would build up within that container and could potentially cause an injury to the user when removing the lid.

Figure 4:
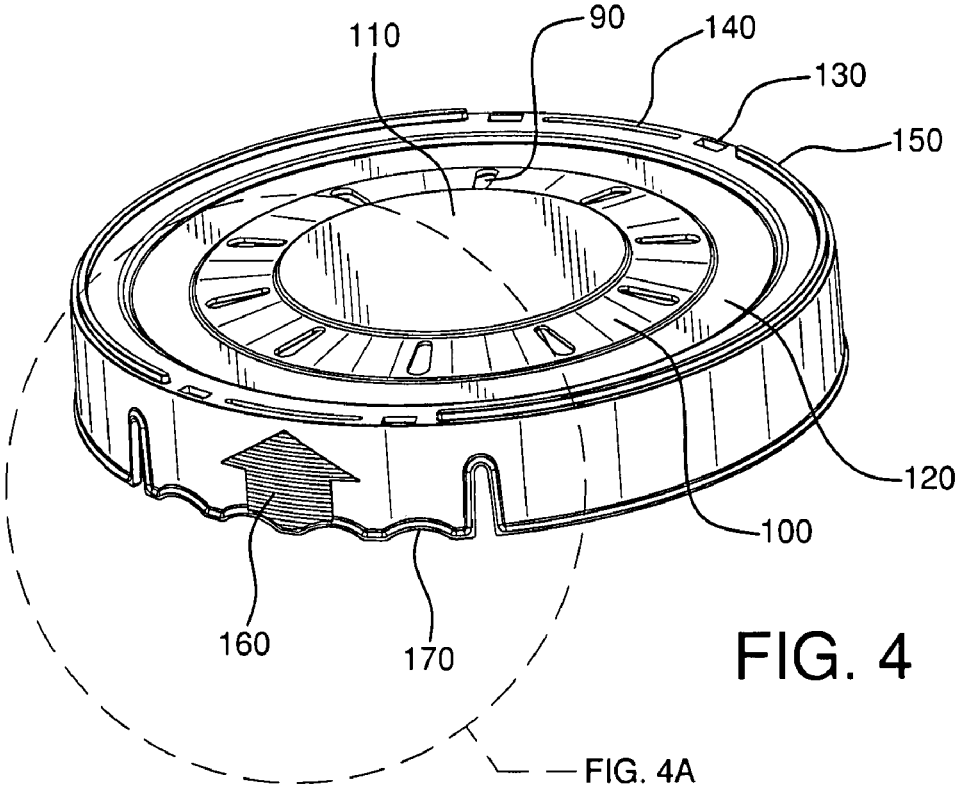
FIG. 4 is an isometric view of the container cover of FIG. 3 illustrating the top of the cover.
Figure 4A:
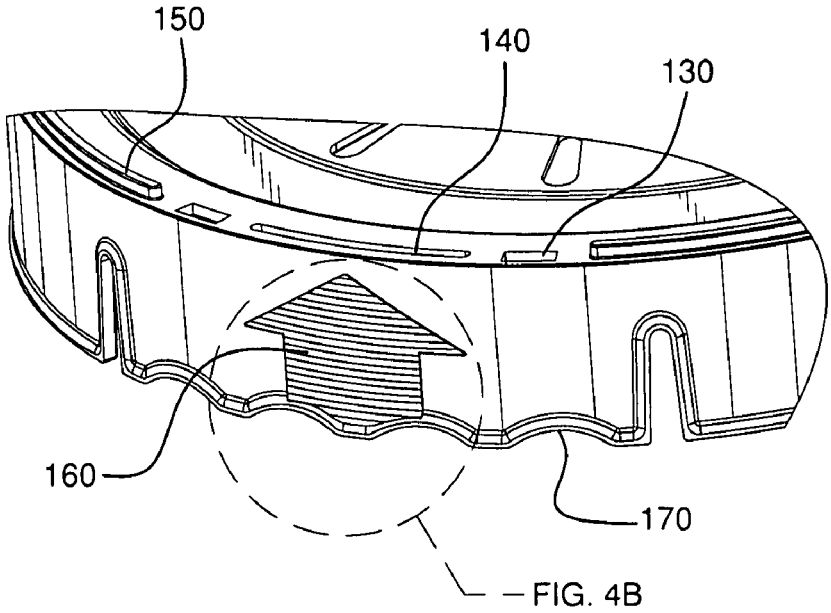
FIG. 4A is an enlarged view of a portion of the cover of FIG. 4.

As shown in FIGS. 3, 3C, and 4, one or more vent holes 90 can be formed in the cover. In the illustrated embodiment, the vent holes 90 are formed on the sloping transition section 100 between the lower annular surface 120 and the upper surface 110. This configuration is designed to create a chimney effect whereupon the heat generated during cooking is channeled toward the center of the cover and escapes through the vents. This keeps the locks and plug seal cooler, and results in less potential for harm to the user while maintaining a better seal. However, while this embodiment is preferred, other numbers or arrangements of vent holes may serve the same purpose.

Figure 4B:
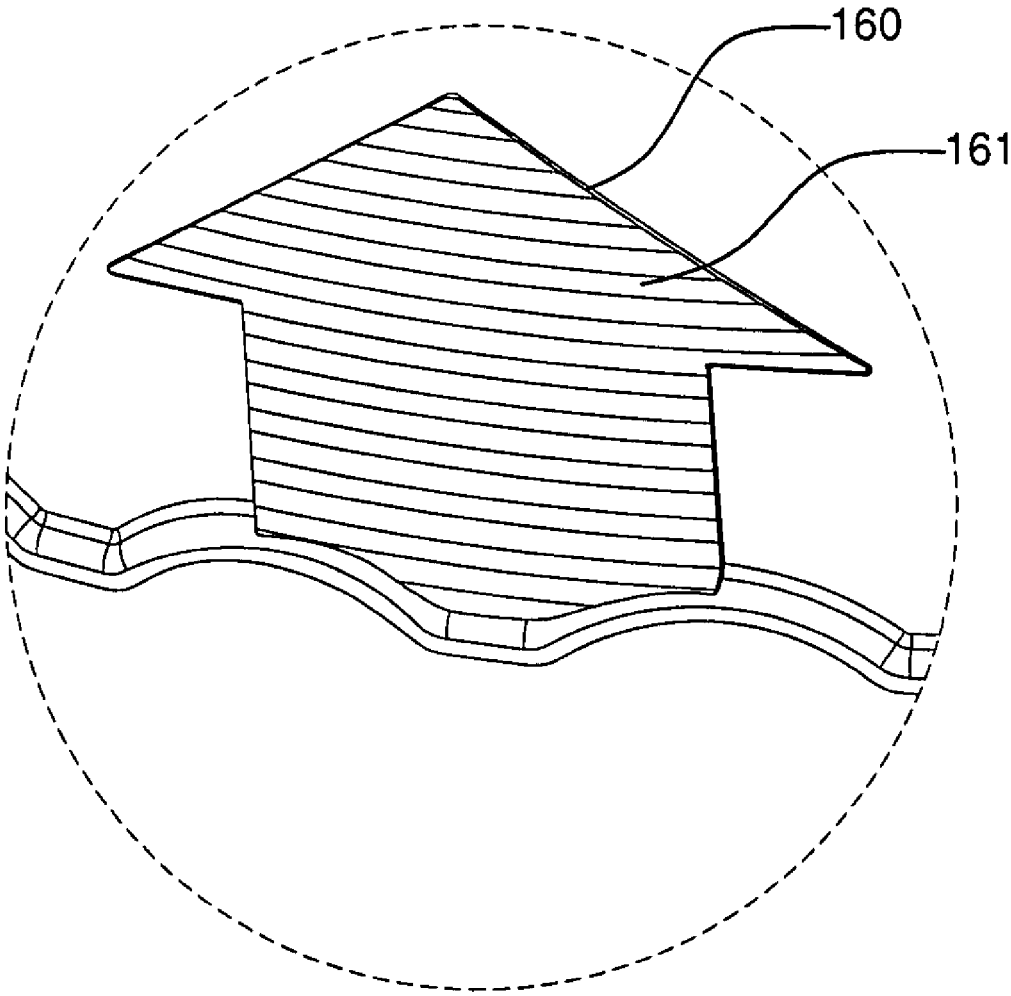
FIG. 4B is an enlarged view of a portion of the cover of FIG. 4A.

Referring now to FIGS. 4, 4A, and 4B, the outside surface of the lock panel 40 preferably has a textured area 160 substantially adjacent to the bottom edge of the panel. The textured area 160 includes a plurality of ridges 161, as can be seen in FIG. 4B. The textured area helps keep the fingers of a user from slipping, such as when removing the cover from the container. As shown in the figures, the textured area may be formed in the shape of an arrow to assist the user in the removal of the cover. FIG. 4A is an enlarged view of the cover in FIG. 4, showing the flexible lock panel 40 defined by slots 80. Also shown is a contoured edge 170 that is formed along the bottom edge of the lock panel 40. The contoured edge 170 includes a plurality of recesses or scallops designed to received the figures of the user. The finger recesses permit easy grasping by the user, thereby assisting in the flexing of the lock panel. While the contour is shown as an arrow in the figures, that is only an optional feature.

Figure 5:
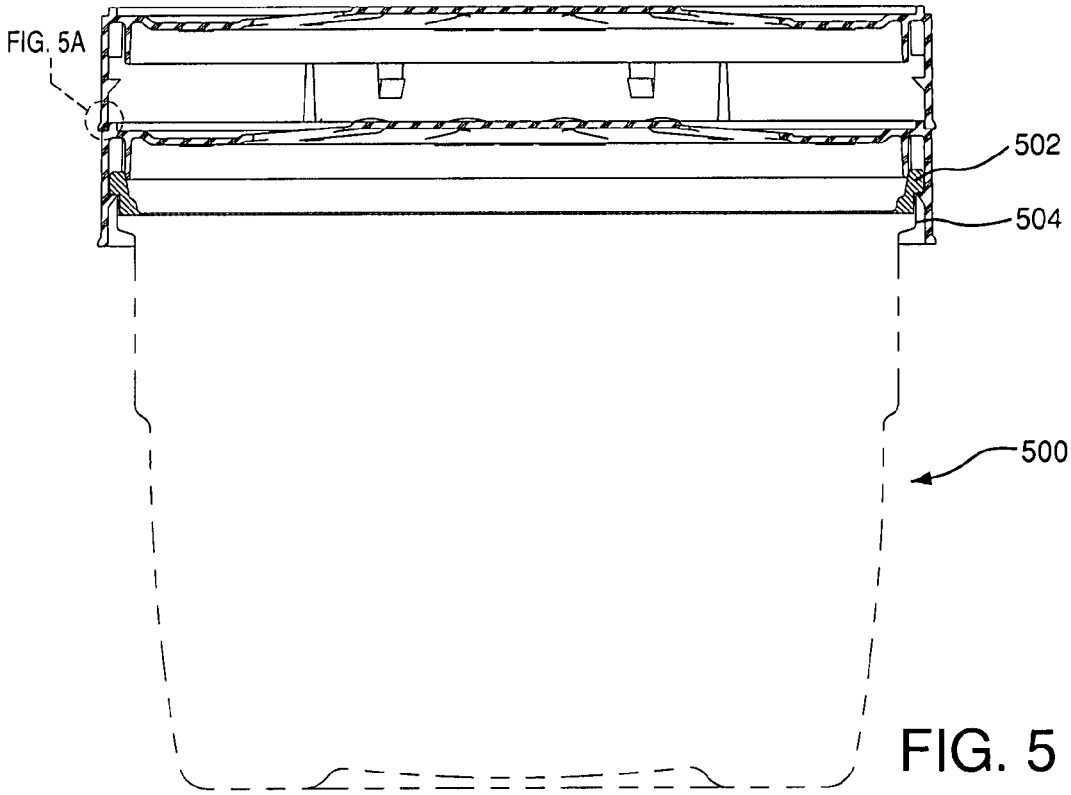
FIG. 5 is a cross-sectional view of a cover according to one embodiment of the invention attached to a container (shown in phantom), and with a second cover stacked on top.
Figure 5A:
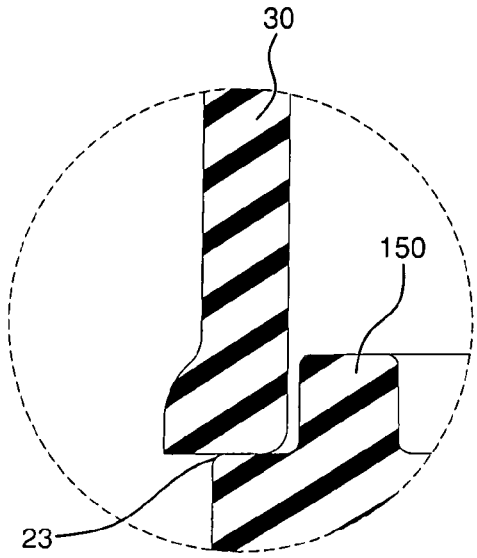
FIG. 5A is an enlarged view of the interface between the two stacked covers of FIG. 5.

As shown in FIGS. 5 and 5A, the lids are designed to be stackable, which makes shipping more convenient. The cover preferably includes a raised top ring 150 (shown more clearly in FIGS. 3, 4, and 4A), which is concentric with the circumferential edge of lid 20. The raised top ring 150 may be interrupted by pass holes 130 and flexing holes 140. The top ring 150 has a diameter smaller than circumferential edge 23 of the cover, thus resulting in a space between edge 23 and ring 150. As shown in FIG. 5A, this space is preferably at least as wide as the thickness of skirt 30, and provides a resting place for the edge of skirt 30 of a second lid when multiple lids are stacked.

In a preferred container/cover configuration, the container has a circular neck, and the cover has two lock panels, one on each side of the cover. There are preferably two lock wedges formed on the inner wall of each lock panel. The stop ribs preferably do not touch the plug seal or cause seal distortions. This leaves the plug seal completely free from all connecting obstructions that create unwanted shrinkage, which can lead to leakage problems. Because the plug seal is uninterrupted, it is completely round and preferably provides a 360 degree seal against the inside of the neck of the container. Locating the locking wedges on the skirt allows for simple assembly by placing the cover over the container and pressing the cover directly down onto the container. When the lock panels engage, they preferably make a distinct snap sound as the locking wedges slide over the container bead. The locking action can also be felt by the user through the finger tips as the locking wedges lock over the container bead.

The lock panels are flexible so that the locking wedges will disengage from and slip over the container bead as the cover is removed. The two actions of pulling on a lock panel and lifting the cover need to be done simultaneously or sequentially to remove the cover. As the cover is lifted (or flexed), the other lock panel(s) flex, so that the locking wedges on those lock panels also disengage from the bead, and the cover can be peeled off of the container.

As can be seen in the figures, the skirt and lock panels are designed to permit flexure. Specifically, as discussed above, the lock panels are defined by a slot extending through the skirt. The slots are preferably about 0.06 inch wide and extend about 0.075 inch over the top of the lock wedge, although other slot sizes and placements can also be used.

It will be apparent to those skilled in the art that various modifications and variations can be made in the configuration of the present invention without departing from the spirit or scope of the invention. It is intended that the present invention cover such modifications and variations provided they come within the scope of the appended claims or their equivalents.

What is claimed is:

1. A removable locking container cover for covering a container having a neck with an outer bead, the cover comprising:

a lid having a top surface, a bottom surface, and a circumferential edge;

a skirt extending downward from the lid at or near the circumferential edge, the skirt having a bottom edge, an outer surface, and an inner surface shaped to extend around the outside of the container neck; and a plug seal extending from the bottom surface of the lid and concentric with the skirt, the plug seal having a smaller diameter than the skirt, the plug seal having an inner surface and an outer surface shaped to be substantially in contact with the inside of the neck of the container;

the skirt including at least one integral lock panel defined by slots formed through the skirt and extending substantially vertically from the bottom edge of the skirt, the lock panel having at least one inwardly projecting locking wedge formed on an inside surface thereof and configured to engage a bottom edge of the outer bead of the container when the cover is locked onto the container so as to removably hold the cover in place on the container;

wherein at least a portion of the bottom edge of the lock panel includes a scalloped contour so as to define finger recesses and the remainder of the bottom edge of the skirt is substantially parallel to the circumferential edge of the lid; and wherein the at least one locking wedge is located to correspond to the portion of the bottom edge that includes a scalloped contour.

2. The container of claim 1 wherein there are two lock panels located on diametrically opposed sides of the cover, and wherein each side of each of the lock panels is defined by a slot formed through the skirt, the slot extending substantially vertically from the bottom edge of the skirt, the slots positioned on the skirt so that the at least one inwardly projecting wedge is located between the slots.

3. The container cover of claim 1, wherein the lid further includes at least one hole extending through the lid so as to allow air to pass through the at least one hole.

4. The container cover of claim 3, wherein the lid comprises a sloping transition section between a lower annular surface and a central upper surface, and wherein the at least one hole is a plurality of holes formed in the sloping transition surface.

5. The container cover of claim 1, wherein a portion of the outer surface of the lock panel between the slots includes a textured surface so as to provide an area of increased friction for grasping by a user's fingertips.

6. The container cover of claim 2, wherein the lock panels are spaced approximately evenly around the circumference of the skirt.

7. The container cover of claim 1, wherein the lid further comprises a plurality of bypass holes passing through the top and bottom surfaces of the lid, each hole located approximately above a locking wedge.

8. The container of claim 2, further comprising a flexing slot passing through the top and bottom surfaces of the lid, the flexing slot located circumferentially between the sides of the lock panel defined by the slots.

9. The container cover of claim 1, further comprising a plurality of stop ribs connected to the inside of the skirt and to the bottom of the lid, the stop ribs disposed so that when all of the locking wedges engage the container outer bead, substantially all the stop ribs touch the top of the container neck so as to limit vertical movement of the cover on the container.

10. The container cover of claim 1, wherein the lid includes a raised top ring extending from the top surface and concentric with the circumferential edge of the lid, the top ring having a diameter smaller than the circumferential edge, and configured to be circumscribed by the inner surface of the skirt of a second cover stacked on the cover.

11. A removable locking container cover for covering a container having a neck with an outer bead, the cover comprising:

a lid having a top surface, a bottom surface, a circumferential edge, and a center section, the center section including a lower annular section, a sloping transition section, an upper section, and a plurality of holes formed in the center section extending through the top and bottom surfaces so as to allow air to pass through the lid;

a skirt extending downward from the lid at or near the circumferential edge, the skirt having a bottom edge, an outer surface, and an inner surface shaped to extend around the outside of the container neck;

a plug seal extending from and formed integral with the bottom surface of the lid and concentric with the skirt, the plug seal having a smaller diameter than the skirt, the plug seal having an inner surface and an outer surface adapted to substantially contact the inside of the neck of the container;

a pair of integral lock panels, each lock panel being defined by slots formed through the skirt and extending substantially vertically from the bottom of the skirt, each lock panel having at least two inwardly projecting locking wedges formed on the inside surface of the skirt and configured to engage a bottom edge of the outer bead of the container when the cover is locked onto a container so as to removably hold the cover in place on the container, the lock panels being spaced approximately 180 degrees from each other around the circumference of the lid, wherein at least a portion of the bottom edge of each lock panel includes a scalloped contour so as to define finger recesses and the remainder of the bottom edge of the skirt is substantially parallel to the circumferential edge of the lid; and wherein each of the at least two inwardly projecting wedges is located to correspond to the portion of the bottom edge that includes a scalloped contour.

12. The cover of claim 11, wherein a portion of the outer surface of the lock panel includes a textured surface so as to provide an area of increased friction for grasping by a user's fingertips.

13. The container cover of claim 11, further comprising a plurality of stop ribs connected to the inside of the skirt and to the bottom of the lid, the stop ribs disposed so that when the locking wedges engage the outer bead, the stop ribs substantially touch the top of the container neck thereby limiting vertical movement of the cover on the container.

14. The container cover of claim 11, wherein the lid further includes a raised top ring projecting upward from the top surface and substantially concentric with the circumferential edge of the lid, the top ring being interrupted on the portion of the lid above the lock panels, the top ring having a diameter that is smaller than the diameter of the circumferential edge, and which is configured to be circumscribed by the inner surface of the skirt of a second cover stacked on the cover.

15. A removable locking container cover for covering a container having a neck with an outer bead, the cover comprising:

a lid having a top surface, a bottom surface, a circumferential edge, and a center section, the center section including a lower annular section, a sloping transition section, an upper section, and a plurality of holes formed in the center section extending through the top and bottom surfaces so as to allow air to pass through the lid;

a skirt extending downward from the lid at or near the circumferential edge, the skirt having a bottom edge, an inner surface, and an outer surface, the inner surface shaped to extend around the outside of the container neck;

a plug seal extending from and formed integral with the bottom surface of the lid and concentric with the skirt, the plug seal having a smaller diameter than the skirt, the plug seal having an inner surface and an outer surface, the outer surface adapted to substantially contact the inside of the neck of the container;

a pair of integral lock panels, each lock panel having at least two inwardly projecting locking wedges formed on the inside surface of the skirt and configured to engage a bottom edge of the outer bead of the container when the cover is locked onto a container so as to removably hold the cover in place on the container, the lock panels being spaced approximately 180 degrees from each other around the circumference of the lid, wherein the sides of each lock panel are defined by slots formed though the skirt, the slots extending substantially vertically from the bottom edge of the skirt, the slots positioned on the skirt so that the at least one inwardly projecting wedge is located between each set of slots; and wherein the lid further includes four bypass holes passing through the top and bottom surfaces of the lid, the bypass holes located on substantially the same diameter as the top ring, each hole located approximately above a locking wedge, the lid further including a flexing slot passing through the top and bottom surfaces of the lid, the flexing slot located between the bypass holes.

16. The container cover of claim 11, wherein the container cover is integrally formed as a single piece of injection molded plastic.

* * * * *